US007484998B2

(12) United States Patent
Benham

(10) Patent No.: US 7,484,998 B2
(45) Date of Patent: Feb. 3, 2009

(54) APPARATUS AND METHOD FOR CONNECTING AN ARRAY OF CABLES TO A CIRCUIT BOARD

(75) Inventor: John E. Benham, Torrington, CT (US)

(73) Assignee: Winchester Electronics Corporation, Wallingford, CT (US)

( * ) Notice: Subject to any disclaimer, the term of this patent is extended or adjusted under 35 U.S.C. 154(b) by 0 days.

(21) Appl. No.: 11/867,326

(22) Filed: Oct. 4, 2007

(65) Prior Publication Data

US 2008/0085632 A1 Apr. 10, 2008

Related U.S. Application Data

(60) Provisional application No. 60/849,019, filed on Oct. 4, 2006.

(51) Int. Cl.
*H01R 9/05* (2006.01)

(52) U.S. Cl. ..... 439/579; 439/289

(58) Field of Classification Search ..... 439/63, 439/289, 579, 581

See application file for complete search history.

(56) References Cited

U.S. PATENT DOCUMENTS

| | | | | |
|---|---|---|---|---|
| 4,667,401 | A * | 5/1987 | Clements et al. | 29/832 |
| 5,190,472 | A | 3/1993 | Voltz et al. | |
| 5,281,762 | A * | 1/1994 | Long et al. | 174/78 |
| 5,516,294 | A | 5/1996 | Andrews et al. | |
| 6,053,770 | A | 4/2000 | Blom | |
| 6,341,961 | B1 * | 1/2002 | Juntwait | 439/63 |
| 6,692,262 | B1 | 2/2004 | Loveless | |
| 6,837,741 | B2 * | 1/2005 | Kuwahara | 439/497 |
| 6,951,482 | B1 * | 10/2005 | Miller et al. | 439/581 |
| 2006/0128216 | A1 | 6/2006 | Feldman | |

OTHER PUBLICATIONS

International Search Report and Written Opinion issued in application No. PCT/US2007/21341 on Mar. 4, 2008, 9 pp.

* cited by examiner

*Primary Examiner*—Thanh-Tam T Le
(74) *Attorney, Agent, or Firm*—Rothwell, Figg, Ernst & Manbeck

(57) ABSTRACT

The present invention provides an apparatus and method for connecting an array of cables (e.g., coaxial cables) to a circuit board (e.g., the surface of the circuit board).

12 Claims, 6 Drawing Sheets

APPARATUS AND METHOD FOR CONNECTING AN ARRAY OF CABLES TO A CIRCUIT BOARD

The present application claims the benefit of U.S. Provisional Patent Application No. 60/849,019, filed on Oct. 4, 2006, which is incorporated herein by this reference.

BACKGROUND

1. Field of the invention

The invention relates to apparatuses and methods for connecting an array of cables to a circuit board.

2. Discussion of the Background

The need to connect an array of coaxial cables to a circuit board often arises. The present invention aims to provide an apparatus and method for meeting this need.

SUMMARY

The present invention provides an apparatus and method for connecting an array of cables (e.g., coaxial cables) to a circuit board (e.g., the surface of the circuit board).

In some embodiments the apparatus includes: a frame; a plurality of holes in the frame, each hole extending from a first surface of the frame to a second surface of the frame, which second surface faces in a direction opposite of the direction in which the first surface faces, and each hole being configured to house an end portion of one of the plurality of cables, wherein the plurality of holes forms a plurality of rows of holes, wherein, for each of the rows, all holes in the row are arranged in a straight line; a plurality of rows of raised ground pads on the second surface of the frame, each raised ground pad having a mating face and projecting outwardly from the second surface, wherein (a) the mating faces of the ground pads are coplanar, (b) for each row of ground pads, the plurality of ground pads in the row are arranged in a straight line, and (c) at least a portion of each row of holes is positioned between one of the ground pad rows and another of the ground pad rows; and a plurality of contacts, each being configured to fit into one of the holes and to receive an end of an inner conductor of one of the cables.

In other embodiments the apparatus includes: a frame having a hole extending from a first surface of the frame to a second surface of the frame; a cable comprising a signal conductor and an outer conductor surrounding the signal conductor, a tip of the signal conductor being located within the hole of the frame and the outer conductor being electrically connected to the frame; a printed circuit board comprising an array of signal pads and a ground plane; a plurality of rows of raised ground pads on the second surface of the frame and electrically connecting the frame to the ground plane of the printed circuit board; and a contact at least partially within the hole and electrically connecting the signal conductor of the cable to one of the signal pads.

In other embodiments the apparatus includes: (1) a contact, the contact comprising: (i) a cylindrical body portion, and (ii) a cylindrical distal end portion connected to a distal end of the body portion, wherein the outer diameter of the distal end portion is less than the outer diameter of the cylindrical body portion, the distal end portion includes a mating face, and a proximal end of the body portion forms a cup; (2) a cable comprising (i) a signal conductor having an end that is in the cup and (ii) an outer conductor surrounding the signal conductor; and (3) adhesive in the cup, the adhesive bonding the end of the signal conductor to the contact. The adhesive may include or consists of solder.

In some embodiment the method includes: obtaining a plurality of cables, each cable comprising a signal conductor and an outer conductor; obtaining a frame comprising (i) a plurality of holes extending from a first surface of the frame to a second surface of the frame and (ii) a plurality of raised ground pads projecting outwardly from the second surface of the frame; obtaining a circuit board comprising an array of signal pads and a ground plane; obtaining a plurality of contacts; arranging the frame relative to the circuit board such that the raised ground pads contact the ground plane of the circuit board; for each cable, connecting an end of the signal conductor of the cable to one of the contacts and connecting the outer conductor of the cable to the frame; placing each contact in one of the holes; and connecting each contact to one of the signal pads.

In other embodiments the method includes: (A) obtaining a plurality of cables; (B) obtaining a frame comprising: (1) a plurality of holes, each hole extending from a first surface of the frame to a second surface of the frame, which second surface faces in a direction opposite of the direction in which the first surface faces, and each hole being configured to house an end portion of one of the plurality of cables, wherein the plurality of holes forms a plurality of rows of holes, wherein, for each of the rows, all of the holes in the row are arranged in a straight line; and (2) a plurality of rows of raised ground pads on the second surface of the frame, each raised ground pad having a mating face and projecting outwardly from the second surface, wherein (a) the mating faces of the ground pads are coplanar, (b) for each row of ground pads, the plurality of ground pads in the row are arranged in a straight line, and (c) at least a portion of each row of holes is positioned between one of the ground pad rows and another of the ground pad rows; (C) for each of the cables, physically and electrically connecting an end portion of an inner conductor of the cable to a contact having a mating face; and (D) for each contact, fixing the contact in one of the holes so that the mating face of the contact is substantially coplanar with the mating faces of the raised ground pads.

BRIEF DESCRIPTION OF THE DRAWINGS

The accompanying drawings, which are incorporated herein and form part of the specification, help illustrate various embodiments of the present invention. In the drawings, like reference numbers indicate identical or functionally similar elements.

DETAILED DESCRIPTION OF PREFERRED EMBODIMENTS

Figure 1:
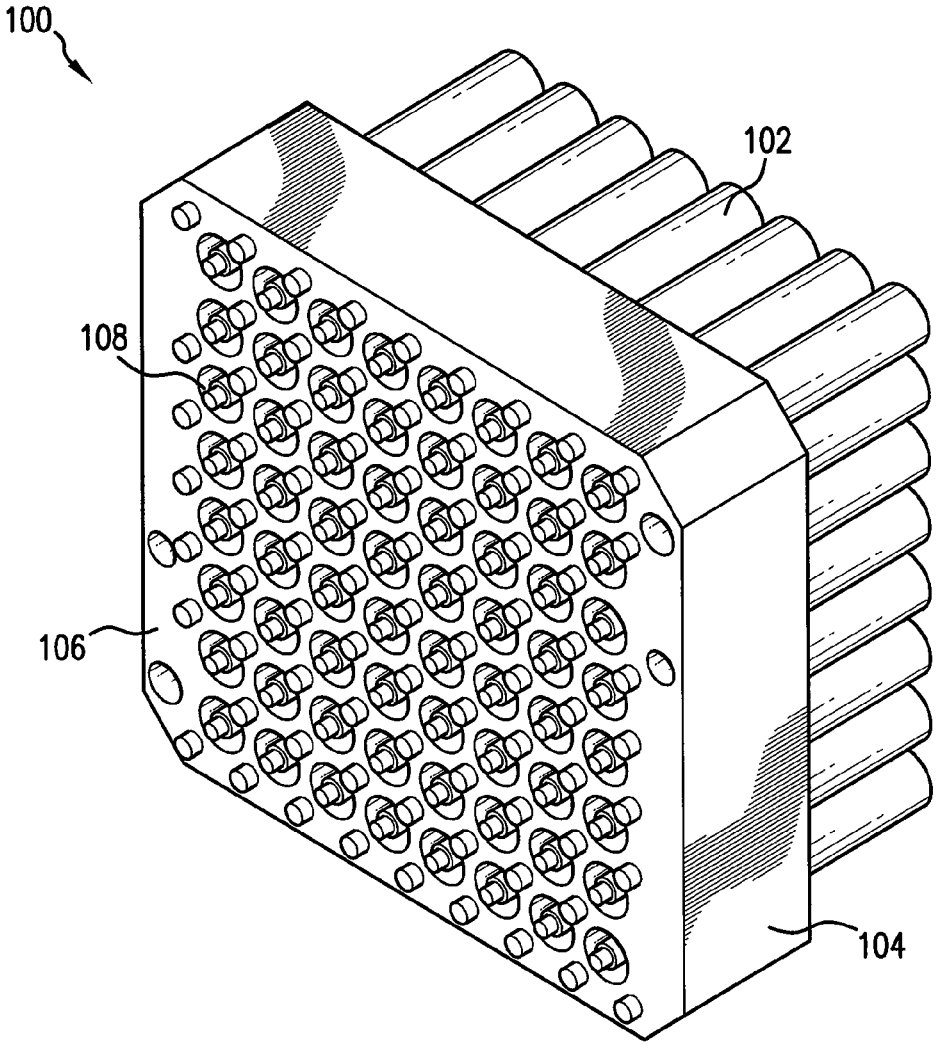
FIG. 1 illustrates an apparatus according to an embodiment.

FIG. 1 illustrates an apparatus 100 according to an embodiment of the invention. Apparatus 100 includes an array of cables 102 connected to a frame 104. In this embodiment, each cable 102 is a coaxial cable. Also, in this embodiment, a mating face 106 of apparatus 100 is configured to mate with a corresponding mating face of a printed circuit board (e.g., to mating face 202 of printed circuit board 200, which is shown in FIG. 2).

Figure 2:
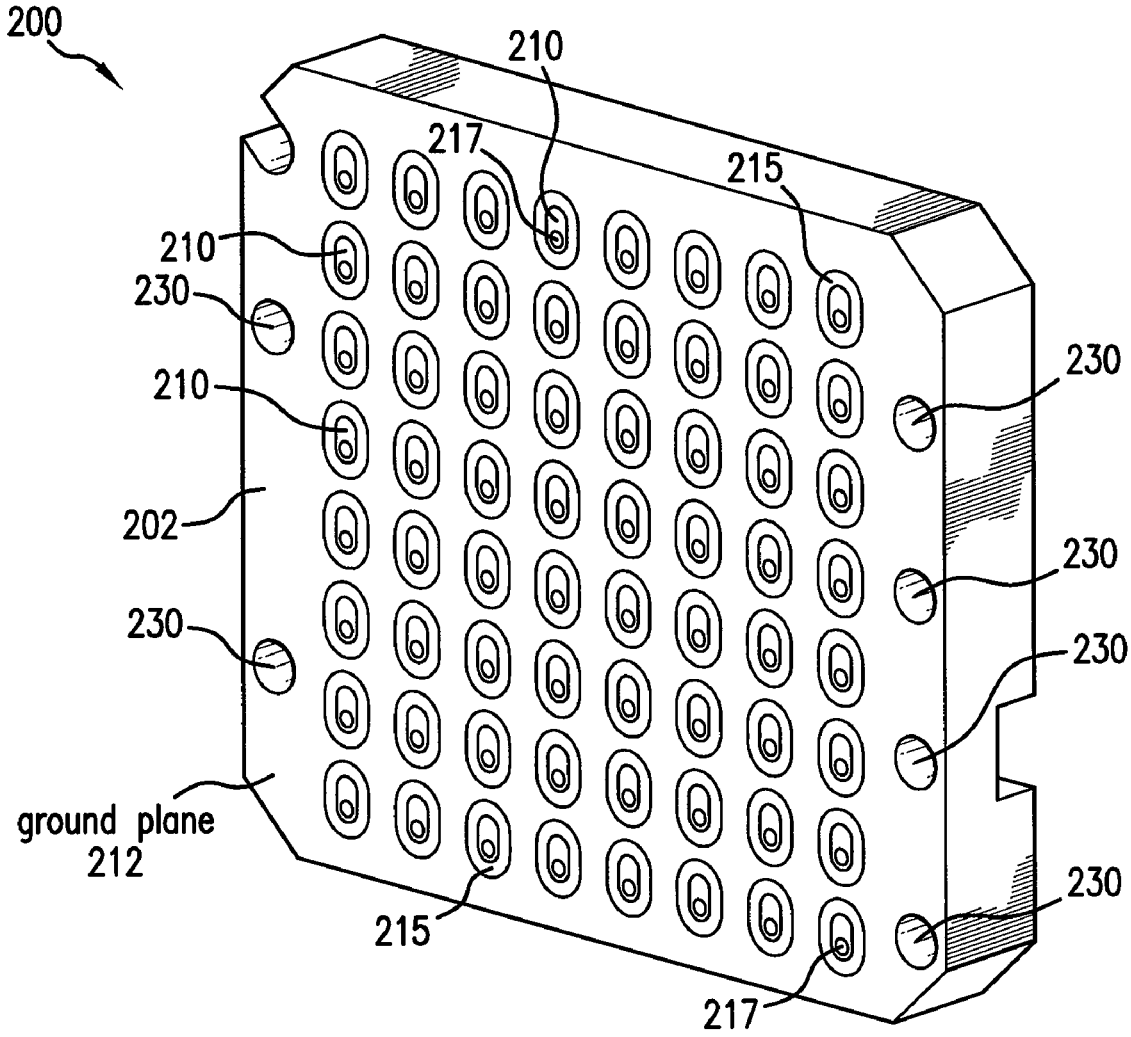
FIG. 2 illustrates a circuit board according to an embodiment.

Referring now to FIG. 2, FIG. 2 illustrates a portion of a printed circuit board 200 with which apparatus 100 is designed to mate. As shown in FIG. 2, circuit board 200 includes an array of signal pads 210, each of which may be completely surrounded by a dielectric 215 ("anti-pad" 215). Dielectric 215 may be air or other dielectric. As also shown, each signal pad 210 may be generally elongate (i.e., having a length greater than its width), be oval or rectangular in shape, and have a hole 217 ("via" 217) located at one end of the pad.

Figure 3:
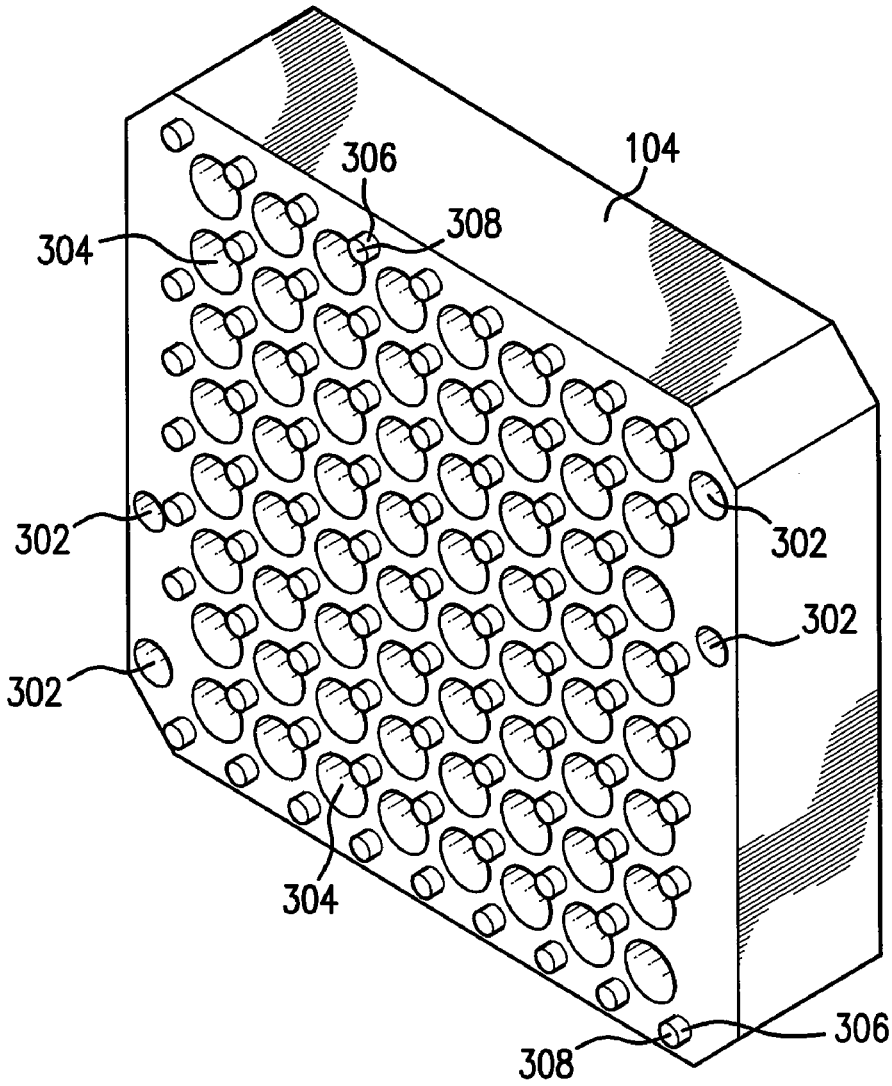
FIG. 3 illustrates a frame according to an embodiment.

Referring now to FIG. 3, FIG. 3 shows frame 104 without the array of cables 102 attached thereto. As illustrated in FIG. 3, frame 104 may include a plurality of alignment holes 302 for facilitating proper alignment when mating with circuit board 200. As shown, in FIG. 2, circuit board 200 may have corresponding alignment holes 230.

Frame 104 also includes an array of cable receiving holes 304 and an array of ground pads 306. Preferably, the grounds pads 306 are raised to create points in a spatial array across the face 106 to facilitate adequate ground return path for the cable 102 to the circuit board 200. That is, each ground pad 306 projects outwardly from mating face 106. In one embodiment, the distance between mating face 308 of ground pad 306 and mating face 106 of frame 104 may be between about 0.01 inches and 0.1 inches. Preferably, the distance between mating face 308 of ground pad 306 and mating face 106 of frame 104 may be about 0.015 inches. Also, it is preferred that each ground pad is raised the same amount so that the face of each is coplanar with the face of the others.

As shown in FIG. 3, the array of cable apertures 304 may be disposed within the array of ground pads 306. That is, in the embodiment shown, the array of holes 304 forms a plurality of rows, the array of pads 306 forms a plurality of rows, and each row of holes 304 is disposed between two rows of pads 306.

Each cable aperture 304 is sized to receive an end portion of a cable 102 and each ground pad 306 is configured to contact a ground plane of a corresponding printed circuit board.

Referring back to FIG. 1, FIG. 1 shows an end portion of each cable 102 being inserted into a corresponding cable aperture 304. As also shown in FIG. 1, a contact 108 is connected to each end of each cable 102, and the tip of the contact 108 extends beyond the mating face 106 so that is it not coplanar with mating face 106. However, in one embodiment, the mating face of each contact 108 is coplanar with the mating faces of the raised ground pads 306. Preferably, the diameter of contact 108 and holes 304 are sized to produce a system impedance of 50 ohms. In one embodiment, air is used to electrically insulate contact 108 from frame 104, which may be constructed from an electrically conducting material or coated with an electrically conducting material. In another embodiment, a bead of dielectric material (e.g., rexalite or other dielectric) may be placed in hole 304 to stabilize and facilitate concentricity of contact 108 with respect to hole 304.

Figure 4:
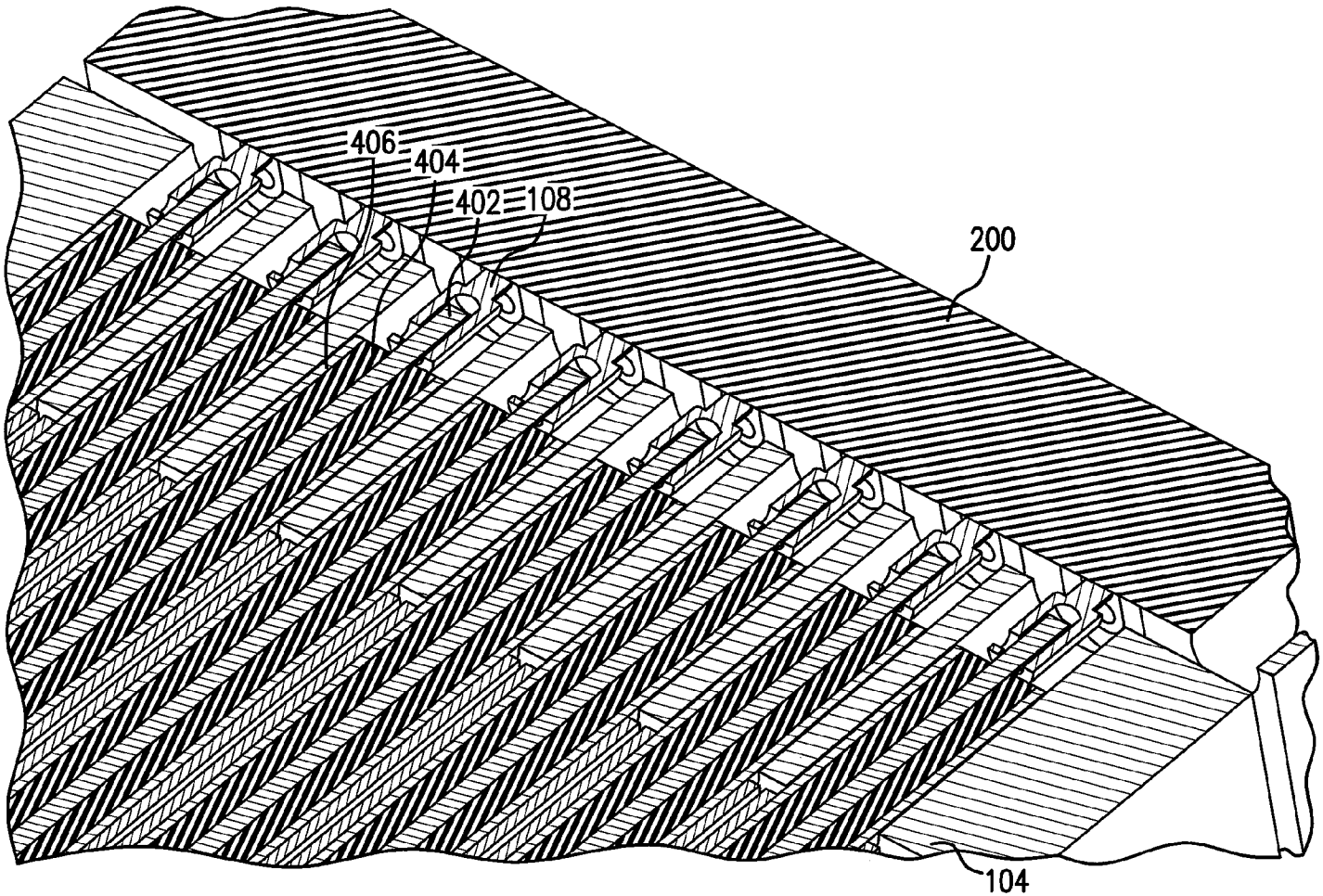
FIG. 4 illustrates the apparatus of FIG. 1 being mated with the circuit board of FIG. 2.
Figure 5:
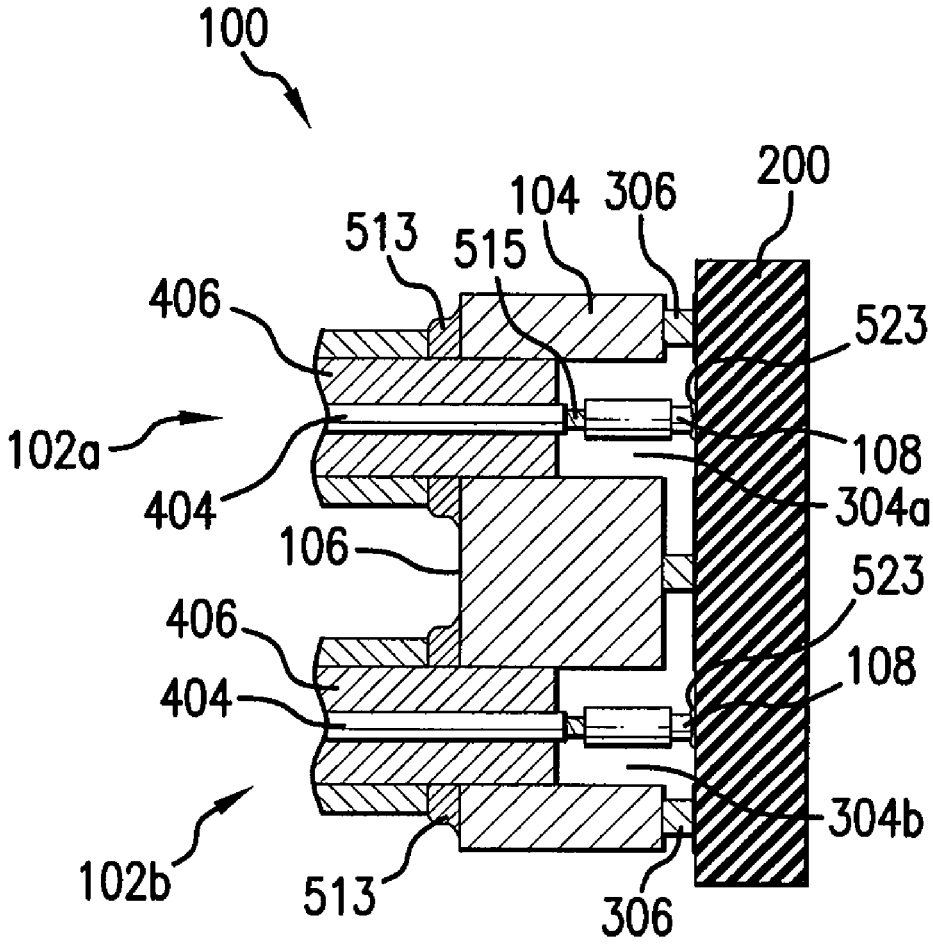
FIG. 5 is a cross-sectional view of an apparatus according to an embodiment.

Referring now to FIGS. 4 and 5, FIG. 4 is a perspective, cross-sectional view of apparatus 100 and FIG. 5 is a cross-sectional view of apparatus 100 and both show apparatus 100 being connected to circuit board 200. In the embodiment shown in FIGS. 4 and 5, cables 102 are coaxial cables. As shown in FIGS. 4 and 5, an end portion of each cable 102 is inserted into a cable aperture 304 (e.g., cable 102*a* is inserted into aperture 304*a* and cable 102*b* is inserted into aperture 304*b*). In one embodiment, an end portion of the inner conductor 402 of each cable 102 extends beyond the insulator 404 and shielding 406 of cable 102. In one embodiment, this end portion (e.g., tip) of inner conductor 402 is physically and electrically attached to contact 108 (e.g., in one embodiment the end portion is inserted into a cavity of contact 108 and an adhesive, such as solder, is used to maintain the end portion within the cavity and to facilitate electrical contact).

As discussed above, and as shown in FIGS. 4 and 5, air may be used to electrically insulate contact 108 from frame 104, however, it is contemplated that a bead of dielectric material may be placed in hole 304. As also discussed above and as shown in FIGS. 4 and 5, the mating face 602 (see FIG. 6) of contact 108 is positioned beyond mating face 106 of frame 104. Thus, when apparatus 100 is mated with circuit board 200, mating face 602 of each contact 108 may press against a corresponding signal pad 210. Similarly, each ground pad 306 of frame 104 presses against a ground plane 212 of circuit board 200.

In some embodiments, a first type of solder (e.g., solder 523) is used to bond contacts 108 with signal pads 210, a second type of solder (e.g., solder 515) is used to bond contacts 108 with the signal conductors of cables 102, and, in the case cable 102 is a coaxial cable, a third type of solder (e.g., solder 513) (or other conductive adhesive—e.g., a conductive glue, tape, etc.) is used to fasten the outer conductor 406 of cable 102 to frame 104. In such an embodiment, the first type of solder may have the lowest melting point, the second type of solder may have the highest melting point, and the third type of solder may have a melting point between the melting point of the first and second types of solder. As shown, solder 513 is used to connect outer conductor 406 to frame 104, and solder 523 is used to connect contact 108 to signal pad 210.

In some embodiments, elements other than solder may be used for bonding contacts 108 to signal pads 210, contacts 108 to the signal conductors and/or the outer conductor 406 to frame 104, including: an epoxy adhesive (e.g., a two part, temperature curing, silver filled epoxy adhesive or other epoxy), a stensil to screen and attach, and other bonding mechanism.

Figure 6:
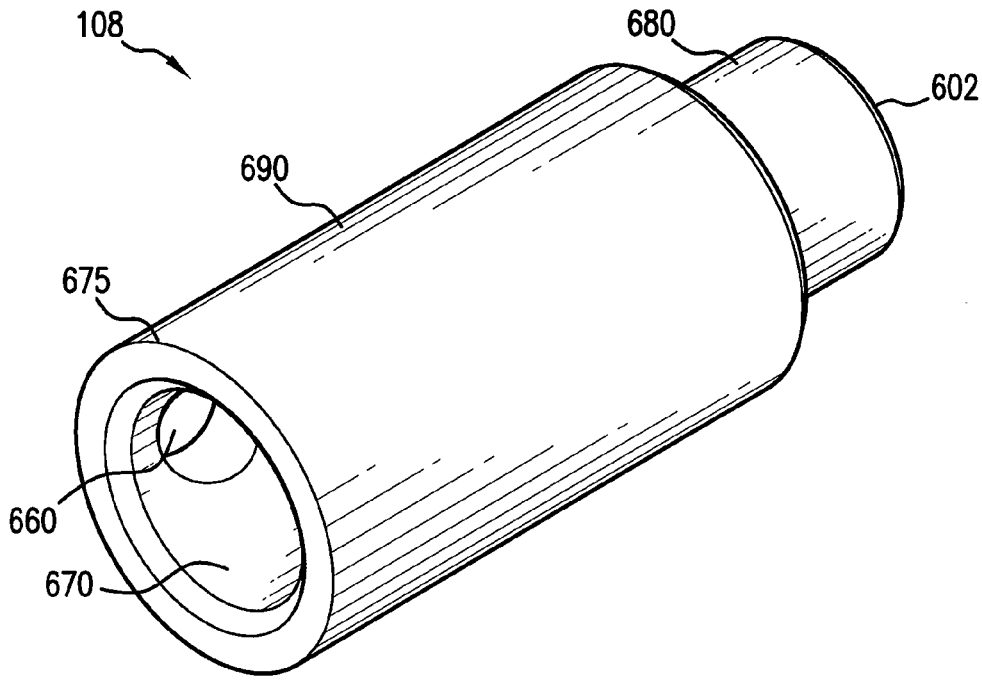
FIG. 6 illustrates a contact according to an embodiment.

Referring now to FIG. 6, FIG. 6 illustrates contact 108 according to one embodiment. As illustrated, contact 108 may include a cylindrical body portion 690 and a cylindrical distal end portion 680, and the outer diameter of body portion 690 may be greater than the outer diameter of end portion 680. As further illustrated, the proximal end 675 of body portion 690 forms a solder cup 670 for receiving the end portion of inner conductor 402 and for receiving solder, which is used to physically fasten contact 108 to conductor 402 and to electrically connect contact 108 with conductor 402. Solder cup 670 may have an aperture 660 in a wall thereof for allowing some solder to flow out of and/or into solder cup 670. The diameter of body portion 690 is sized to achieve a desired system impedance.

While various embodiments/variations of the present invention have been described above, it should be understood that they have been presented by way of example only, and not limitation. Thus, the breadth and scope of the present invention should not be limited by any of the above-described exemplary embodiments. Further, unless stated, none of the above embodiments are mutually exclusive. Thus, the present invention may include any combinations and/or integrations of the features of the various embodiments.

What is claimed is:

1. A connector apparatus for connecting a plurality of cables to a circuit board, comprising:

a frame;

a plurality of holes in the frame, each hole extending from a first surface of the frame to a second surface of the frame, which second surface faces in a direction opposite of the direction in which the first surface faces, and each hole being configured to house an end portion of one of the plurality of cables, wherein the plurality of holes forms a plurality of rows of holes, wherein, for each of the rows, all holes in the row are arranged in a straight line;

a plurality of rows of raised ground pads on the second surface of the frame, each raised ground pad having a mating face and projecting outwardly from the second surface, wherein (a) the mating faces of the ground pads are coplanar, (b) for each row of ground pads, the plurality of ground pads in the row are arranged in a straight line, and (c) at least a portion of each row of holes is positioned between one of the ground pad rows and another of the ground pad rows; and a plurality of contacts, each being configured to fit into one of the holes and to receive an end of an inner conductor of one of the cables;

wherein said each raised ground pad is a solid, substantially cylindrical contact element.

2. The connecter apparatus of claim 1, wherein the cables are coaxial cables.

3. The connecter apparatus of claim 1, wherein the diameters of the contacts and the holes are sized to produce a system impedance of 50 ohms.

4. The connector apparatus of claim 1, wherein each of the plurality of contacts has a mating face for contacting a signal pad, and each of the plurality of contacts is positioned in one of said holes such that, for each said contact, the mating face of the contact is coplanar with the mating faces of the ground pads.

5. The connector apparatus of claim 1, wherein each of the plurality of contacts has a mating face for contacting a signal pad, and each of the plurality of contacts is positioned in one of said holes such that, for each said contact, the mating face of the contact extends beyond the second surface of the frame.

6. An apparatus comprising:

a frame having a hole extending from a first surface of the frame to a second surface of the frame;

a cable comprising a signal conductor and an outer conductor surrounding the signal conductor, a tip of the signal conductor being located within the hole of the frame and the outer conductor being electrically connected to the frame;

a printed circuit board comprising an array of signal pads and a ground plane;

a plurality of rows of raised ground pads on the second surface of the frame and electrically connecting the frame to the ground plane of the printed circuit board; and a contact at least partially within the hole and electrically connecting the signal conductor of the cable to one of the signal pads, wherein the contact is connected to a signal pad with a first type of adhesive, the contact is connected to the signal conductor with a second type of adhesive, and the outer conductor is connected to the frame with a third type of adhesive.

7. The apparatus of claim 6, wherein the first type of adhesive has a first melting point, the second type of adhesive has a second melting point that is higher than the first melting point, and the third type of adhesive has a melting point between the first melting point and the second melting point.

8. The apparatus of claim 6, wherein the cable is a coaxial cable.

9. The apparatus of claim 6, wherein a diameter of the contact and a diameter of the hole are sized to produce an impedance of 50 ohms.

10. The apparatus of claim 6, wherein the first type of adhesive is a first type of solder, the second type of adhesive is a second type of solder, and the third type of adhesive is a third type of solder.

11. The apparatus of claim 10, wherein the first type of solder has a first melting point, the second type of solder has a second melting point that is higher than the first melting point, and the third type of solder has a melting point between the first melting point and the second melting point.

12. The apparatus of claim 6, wherein the first type of adhesive, the second type of adhesive, and/or the third type of adhesive comprises a silver filled two part epoxy.

* * * * *